US009414666B2

(12) United States Patent
Smith

(10) Patent No.: US 9,414,666 B2
(45) Date of Patent: Aug. 16, 2016

(54) GARMENT WITH INTEGRATED HYDRATION SYSTEM

(71) Applicant: Keith Patrick Smith, Langley (CA)

(72) Inventor: Keith Patrick Smith, Langley (CA)

( * ) Notice: Subject to any disclaimer, the term of this patent is extended or adjusted under 35 U.S.C. 154(b) by 55 days.

(21) Appl. No.: 14/541,326

(22) Filed: Nov. 14, 2014

(65) Prior Publication Data

US 2016/0135573 A1 May 19, 2016

(51) Int. Cl.

| | |
|---|---|
| ***B67D 7/84*** | (2010.01) |
| ***A45F 3/20*** | (2006.01) |
| ***A41D 3/00*** | (2006.01) |
| ***A41D 27/00*** | (2006.01) |
| *A45F 3/00* | (2006.01) |

(52) U.S. Cl.
CPC ... *A45F 3/20* (2013.01); *A41D 3/00* (2013.01); *A41D 27/00* (2013.01); *A45F 2003/003* (2013.01)

(58) Field of Classification Search
CPC ..... A45F 3/20; A45F 2003/003; A41D 3/00; A41D 27/00
USPC ..... 222/175
See application file for complete search history.

(56) References Cited

U.S. PATENT DOCUMENTS

| | | | | |
|---|---|---|---|---|
| 4,569,089 | A * | 2/1986 | Nesse | A41D 3/00 2/102 |
| 5,033,115 | A | 7/1991 | Bowling et al. | |
| 5,718,000 | A * | 2/1998 | Ost | A41D 3/00 2/102 |
| 7,296,302 | B2 | 11/2007 | DeLorenzo et al. | |
| 2002/0124294 | A1 | 9/2002 | McKenzie et al. | |
| 2004/0118942 | A1 * | 6/2004 | Courtney | B63C 9/1255 239/302 |
| 2005/0150031 | A1 | 7/2005 | Schrader | |
| 2008/0277443 | A1 | 11/2008 | Thiriot et al. | |
| 2010/0282803 | A1 | 11/2010 | Simmons | |
| 2011/0113524 | A1 * | 5/2011 | Sinder | A45F 3/20 2/93 |
| 2013/0146161 | A1 * | 6/2013 | Herivel | A45F 3/20 137/565.01 |

FOREIGN PATENT DOCUMENTS

| | | |
|---|---|---|
| AU | 2012/100188 | 3/2012 |
| WO | WO 01/39620 A1 | 6/2001 |

* cited by examiner

*Primary Examiner* — Patrick M Buechner
*Assistant Examiner* — Jeremy W Carroll
(74) *Attorney, Agent, or Firm* — McQIPLaw; Jeffrey McQuiston

(57) ABSTRACT

The present invention is directed to a garment with an integrated hydration system comprising a jacket, a first fluid reservoir removably enclosed within a first pocket on the inside along a lateral side of said jacket, a second fluid reservoir removably enclosed within a second pocket on the inside along the other lateral side of said jacket, a first flexible connecting tube connecting said first fluid reservoir to a mouthpiece, and a second flexible connecting tube connecting said second fluid reservoir to said mouthpiece, said mouthpiece comprising a selector valve to allow a user to select between drinking from said first fluid reservoir and said second fluid reservoir.

16 Claims, 4 Drawing Sheets

GARMENT WITH INTEGRATED HYDRATION SYSTEM

BACKGROUND OF THE INVENTION

1. Technical Field

The present invention relates to a garment with an integrated hydration system, suitable for use by skiers and snowboarders.

2. Description of Related Art

Many people like to partake in outdoor activities that require strenuous exertion, and need to remain hydrated while doing so. This need is very inconvenient, as some of these activities such as skiing, snowboarding and snowmobiling require participants to be in more remote locations. The use of water bottles is an insufficient solution to this problem as many sports, including the aforementioned ones, require participants to maintain free use of their hands for balance and control. Moreover, the use of water bottles also raises the risk of injury to the individual during a fall because the person may land on the water bottle. Relying on water bottles also inconveniences participants by interrupting their activities and even requiring them to remove protective gear such as gloves to open the bottle, thereby exposing participants to the elements.

Hydration packs allow the user to hydrate themselves without interrupting the sports activity and do not require continuous use of the individual's hands. However they are typically worn as a backpack, which is often subject to impact when users fall. Further, because backpacks are typically worn on the outside of the user's clothing, the fluid in the reservoir is subject to freezing if the user is engaged in winter sports such as skiing, snowboarding or snowmobiling. And because hydration packs are designed to be worn on the back by the user they are more prone to damage when the person engaged in sporting activities falls on their back. Backpacks also present a problem for skiers and snowboarders riding chairlifts because the do not allow the user to lean back against the chair backrest and may even be caught on a moving chairlift, causing a significant safety hazard.

While some hydration systems are incorporated into a garment, they are still located on the back and therefore don't reduce the risk of damage when the user falls.

U.S. Publication No. US2008/0277443 describes a hydration system designed specially for firefighters. The hydration system is incorporated into a frame that is to be worn on the exterior of a firefighter's coat. The hydration system is designed to be hands free and makes up only one part of the frame, as it is to be multifunctional for the use of a firefighter. The pouch containing the hydration system is one of two pouches that are fixed to the frame. The other pouch is not a hydration system, and intended to be used to hold protective survival gear for the firefighter such as a mask and one other accessory.

Australia Patent Application No. AU2012/100188 describes a hydration system that is attached to a jacket or coat. The fluid reservoir of the hydration system is located in a pouch on the inside of the back of the jacket or coat. Attached to the pouch is a flexible tube. The tube runs along the torso of the body from the back to the front. There is an opening in the front of the torso where the tube can temporarily pass through for the wearer's use. This allows the user to access the hydration system by pulling the flexible tube through the opening. Normally the flexible tube remains within the garment until needed.

U.S. Publication No. US2002/0124294 describes a hydration system for surfers and other sports participants. This hydration system is designed to minimize the disruption of the sports activity. The hydration system contains a removable fluid container to which is attached flexible tubing. It is to be worn on the inside of the back of an upper body garment, such as a wetsuit vest. The garment is made of a semi-flexible material that is stiff enough to maintain its shape and adjust to the physique of the user. The garment also includes side panels made up of material that is both flexible and body conforming such as Lycra®.

Thus, there exists a continuing need for a garment with an integrated hydration system having fluid reservoirs located along the sides of the garment. The position of the reservoir pouches reduces possibility of damage to the hydration system when the user falls on their back, as is common in outdoor activities such as skiing and snowboarding. The present invention substantially fulfills this need.

SUMMARY OF THE INVENTION

The present invention is directed to a garment with an integrated hydration system comprising a jacket, a first fluid reservoir removably enclosed within a first pocket on the inside along a lateral side of said jacket, a second fluid reservoir removably enclosed within a second pocket on the inside along the other lateral side of said jacket, a first flexible connecting tube connecting said first fluid reservoir to a mouthpiece, and a second flexible connecting tube connecting said second fluid reservoir to said mouthpiece, said mouthpiece comprising a selector valve to allow a user to select between drinking from said first fluid reservoir and said second fluid reservoir.

BRIEF DESCRIPTION OF THE DRAWINGS

The invention will be better understood and objects other than those set forth above will become apparent when consideration is given to the following detailed description thereof. Such description makes reference to the annexed drawings wherein.

In the following description of the invention similar reference characters refer to similar parts throughout the several views of the drawings.

DETAILED DESCRIPTION

Figure 1:
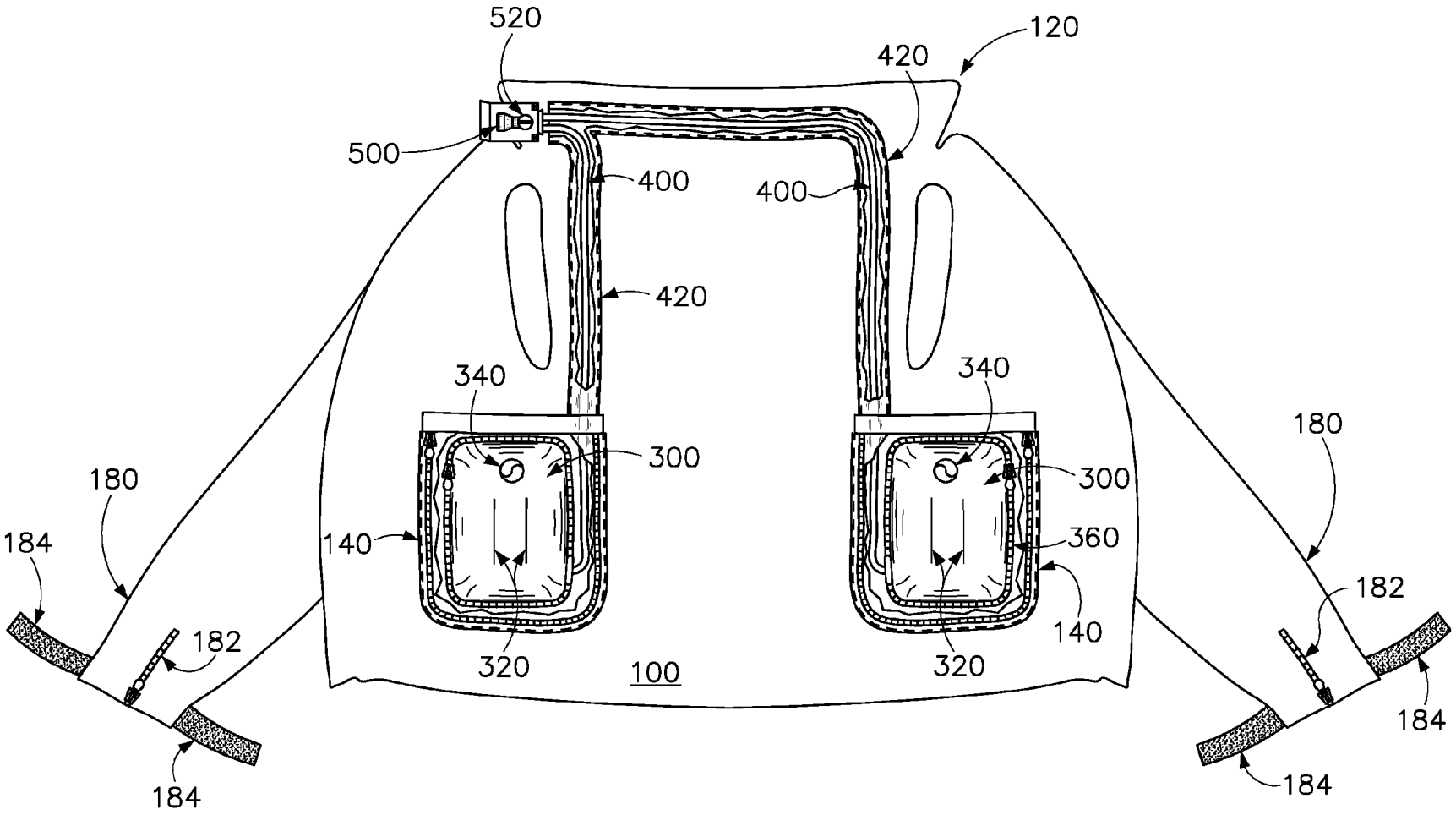
FIG. 1 is a front view of a garment of the present invention having an integrated hydration system.

FIG. 1 shows a jacket 100 of the present invention having an integrated hydration system. Jacket 100 includes jacket collar 120 and pockets 140. Pockets 140 are adapted to contain fluid reservoirs 300. As shown in FIG. 1, each fluid reservoir 300 is sectioned by a pair of seams 320. Seams 320, when present, prevent reservoirs 300 from sagging at the bottom when filled or partially filled with fluid, as they create chambers within fluid reservoirs 300. Fluid reservoirs 300 are positioned along the sides of jacket 100, so that when in use each fluid reservoir 300 is located between the user's armpit and hip bone. This arrangement protects fluid reservoirs 300 from impact when the user falls on his or her back, as is common during snowboarding and skiing. In addition, the location of the fluid reservoirs between the user's arm pit and hip bone protects the fluid reservoirs from impact when the user falls on his or her side because the point of impact tends to be the person's hip. Further, because fluid reservoirs 300 are located inside, rather than outside, jacket 100, the fluid within fluid reservoirs 300 is less susceptible to freezing during use in cold environments.

Fluid reservoirs 300, which are removable for ease of cleaning and filling, may be filled and emptied via reservoir fill holes 340. As shown in FIG. 1, each of fluid reservoirs 300 has a pocket zipper 360 that enables fluid reservoir 300 to be zipped to pocket 140, which reduces movement of fluid reservoirs 300 while in use, thereby providing improved comfort to the user. In addition, securing fluid reservoirs 300 inside pockets 140 provides a barrier between the fluid reservoirs and the individual, thereby reducing the transfer of heat from the individual to the fluid reservoir and the likelihood that condensation on the reservoir will wet the individual. Alternatively, fluid reservoirs 300 may be secured to jacket pockets 140 by one or more hook-and-loop fasteners. Connecting tubes 400 connect fluid reservoirs 300 to mouthpiece 500. As shown in FIG. 1, connecting tubes 400 attach to fluid reservoirs 300 along the side edges of the fluid reservoirs 300, and are easily detachable therefrom. This arrangement provides for a flatter, less bulky profile for fluid reservoirs 300. Connecting tubes 400 are located within tube channels 420, which run along the inside of jacket 100 and exit at jacket collar 120. This arrangement hides the hydration system, making its appearance more discrete while also making it easy to access both liquid reservoirs for use. Connecting tubes 400 connect to mouthpiece 500, which is visible just outside jacket collar 120. Mouthpiece 500 includes a valve 520 that allows the user to select the fluid reservoir 300 from which to drink. Having two fluid reservoirs 300 allows for the consumption of more fluid, thereby extending the time during which the user may avoid having to discontinue their activity to re-hydrate. It also gives the user more control over hydration system, as it allows a user, if desired, to fill one of fluid reservoirs 300 within one fluid and the other fluid reservoir 300 with a different fluid. In addition, the use of two fluid reservoirs 300 located along the sides of the individual allows for equal weight distribution and improved balance for the individual, which can be very advantageous in sporting activities like snowboarding and skiing, which require excellent balance.

As shown in FIG. 1, jacket 100 may include an optional zipper 182 and an optional hook-and-loop fastener strap 184 at each of sleeve cuffs 180 to allow a wearer to open and close sleeve cuffs 180 easily. The sleeve cuff openings may be from about one inch to about 6 inches in length. This would permit a wearer to put on ski gloves and tighten sleeve cuffs 180 over the gloves without having to first remove jacket 100. In one embodiment the sleeve cuff openings are from two inches to five inches in length. In another embodiment the sleeve cuff openings are from three to four inches in length. Other common closure means, such as buttons or snaps, of course, may be used in place of a zipper and a hook-and-loop fastener. Jacket 100 also may include a removable face warmer 125 attached to jacket collar 120 (see FIG. 4).

Figure 2:
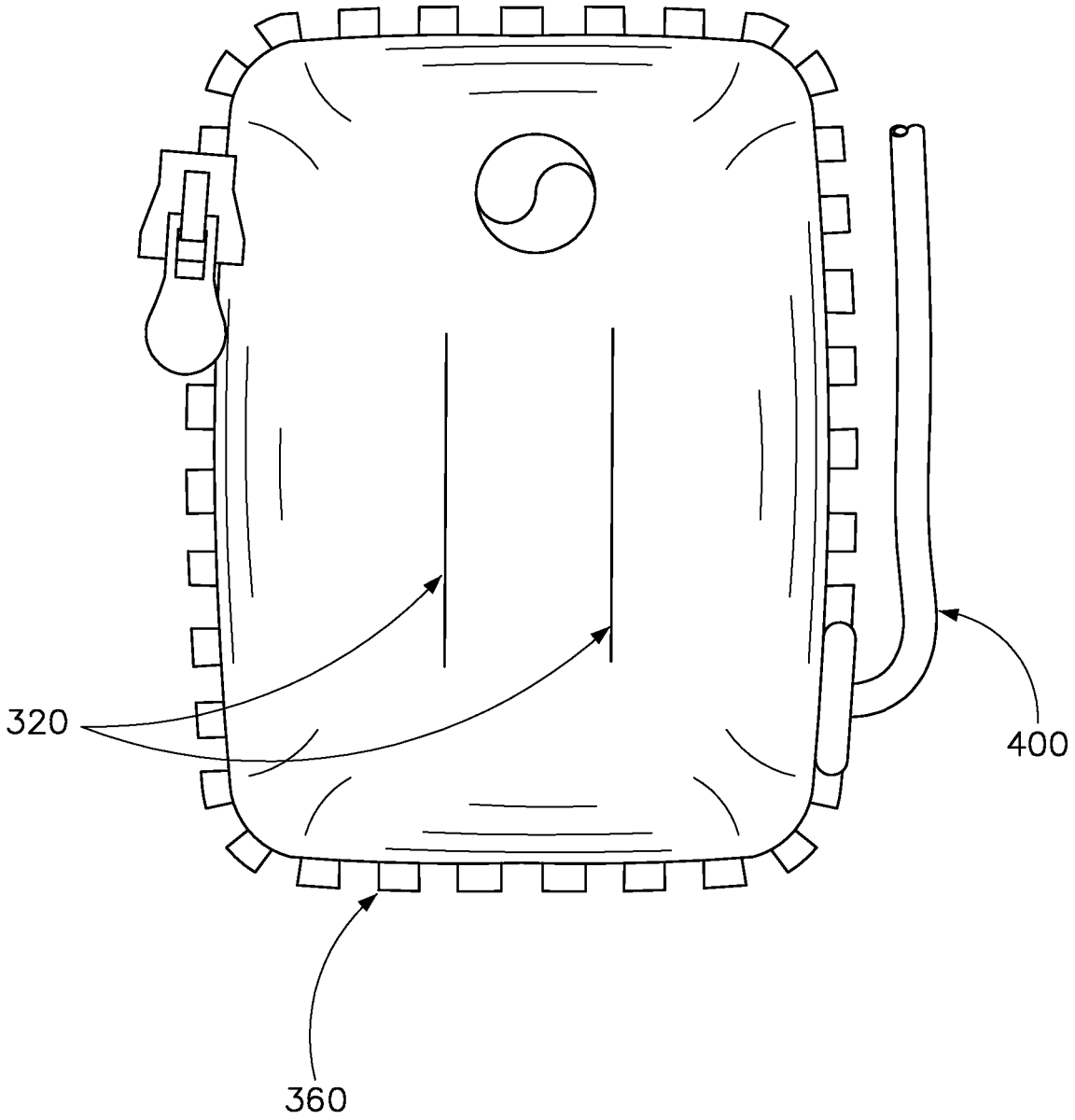
FIG. 2 is a front view of a fluid reservoir of the invention.

FIG. 2 shows an enlarged view of fluid reservoir 300. Seams 320 create three fluid chambers, thereby preventing fluid reservoir 300 from sagging at the bottom when filled or partially filled with fluid. As shown, seams 320 allow for even distribution of fluid throughout fluid reservoirs 300. Fluid reservoir 300 may be filled or emptied via reservoir fill hole 340. As stated above, fluid reservoir 300 has a pocket zipper 360 that enables fluid reservoir 300 to be zipped to pocket 140, which reduces movement of fluid reservoir 300 while in use, thereby providing improved comfort to the user. FIG. 2 further shows connecting tube 400 attached to fluid reservoir 300 towards the bottom along a side edge. As stated above, this arrangement provides for a flatter, less bulky profile for fluid reservoirs 300. Connecting tube 400 runs along the inside of jacket 100, within tube channel 420, and attaches to mouthpiece 500.

Figure 3:
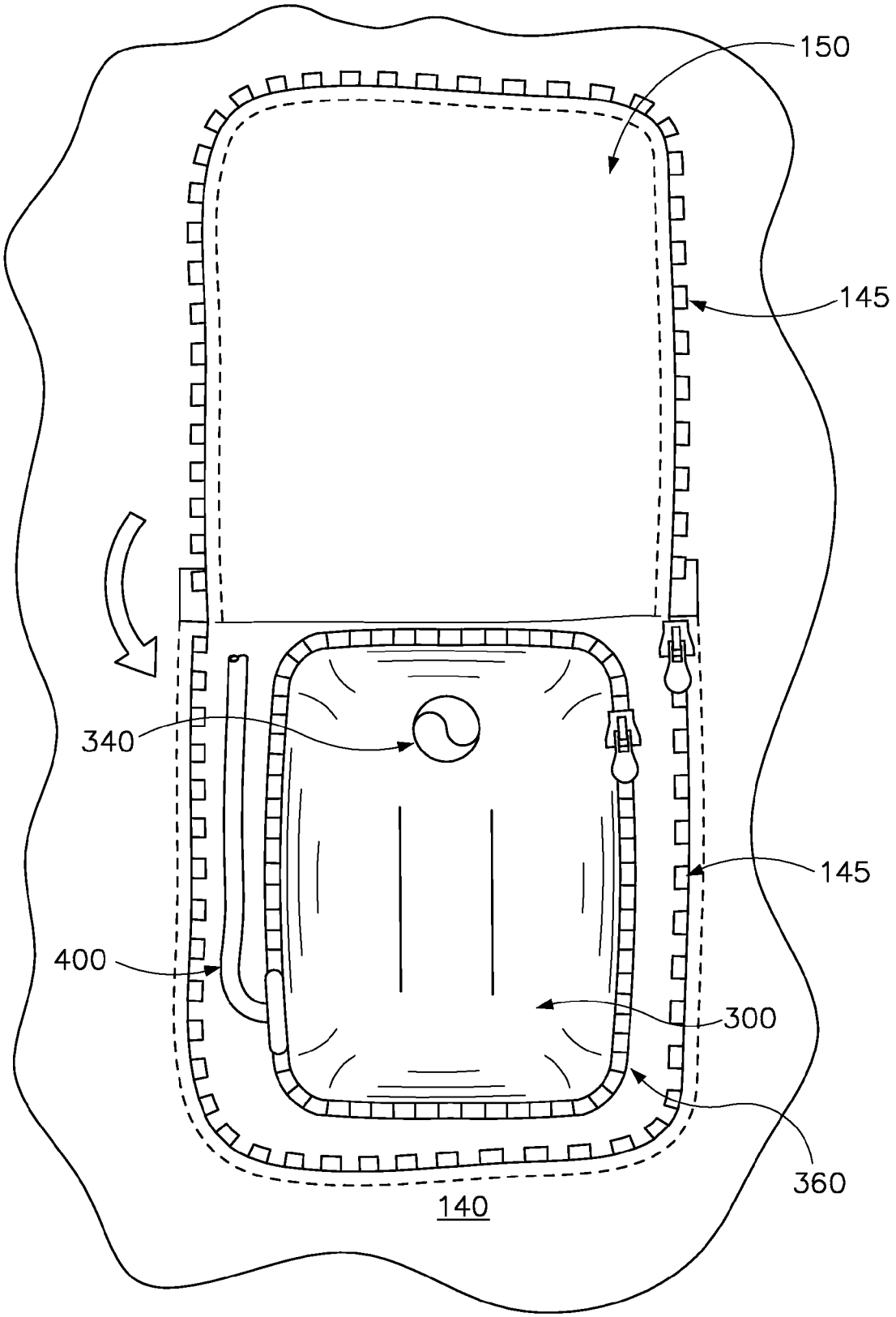
FIG. 3 is a front view of a reservoir of the present invention located within a pocket of garment of the present invention.

FIG. 3 shows jacket pocket 140 having zipper 145 and flap 150. Fluid reservoir 300 is zipped to jacket pocket 140 using pocket zipper 360. To further secure fluid reservoir 300 within jacket pocket 140, flap 150 folds down and jacket pocket 140 may be zipped closed using zipper 145.

Figure 4:
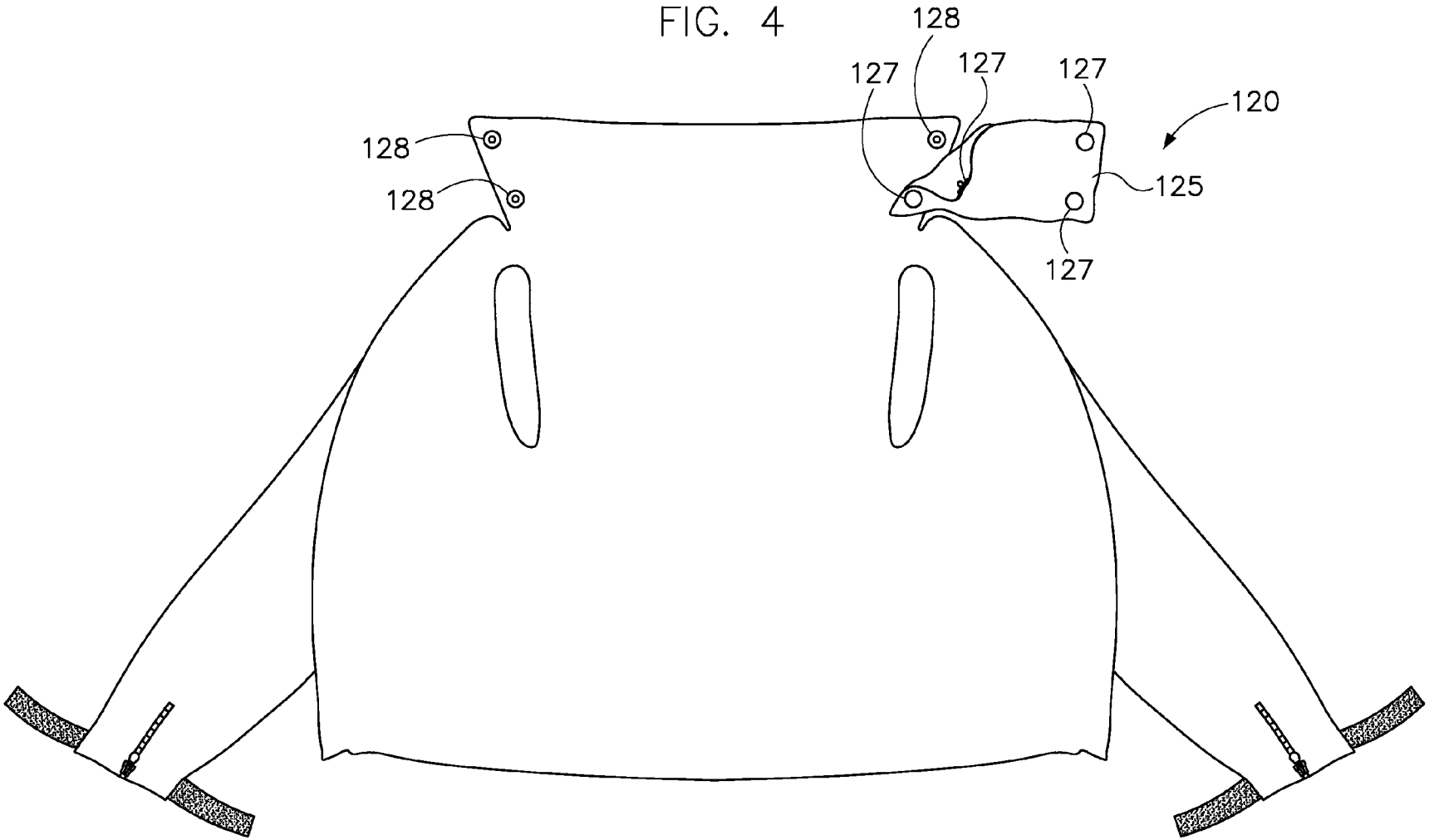
FIG. 4 is a front view of the jacket of the invention having a removable face warmer attached to the jacket collar.

FIG. 4 shows an enlarged view of jacket collar 120 with removable face warmer 125. As shown, face warmer 125 is removably attached to jacket collar 120 via face warmer snap buttons 127 and jacket collar snap buttons 128. Of course, other attachment means, such as, for example, hook and loop fasteners or zippers, may be used instead of snap buttons. Face warmer 125 may be designed to take the shape of the front portion of jacket collar 120 when face warmer snap buttons 127 are secured to jacket snap buttons 128. Face warmer 125 allows an individual to adjust the amount of heat the individual would like to retain or release at neck area. For example, an individual could secure face warmer 125 to jacket collar 120 using face warmer snap buttons 127 and jacket collar snap buttons 128 while unzipping jacket 100 in order to keep the individual's neck and face area warm while cooling off the individual's trunk. Alternatively, the individual could maximize heat retention by zipping up jacket 100 and securing face warmer 125 to jacket collar 120 using face warmer snap buttons 127 and jacket collar snap buttons 128. In certain embodiments the attachment means allows the position of the position of face warmer 125 to be adjusted, for example, to allow a tighter or looser fit against the user's face or neck.

While particular embodiments of the present invention have been shown and described herein for purposes of illustration, it will be understood that the invention is not limited thereto. Modifications may be made by persons skilled in the art, particularly in light of the foregoing teachings, without deviating from the spirit and scope of the invention. Accordingly, the invention is not limited except as by the appended claims.

All of the U.S. patents referred to in this specification are incorporated herein by reference in their entirety to the extent not inconsistent with the present description.

What is claimed is:

1. A garment with an integrated hydration system comprising a jacket, a first fluid reservoir removably enclosed within a first pocket aligned along a side of a user between an armpit and a hip bone of the user along a lateral side of said jacket, a second fluid reservoir removably enclosed within a second pocket aligned along a second side of the user between an armpit and the hip bone of the user along a second lateral side of said jacket, a first reservoir-pocket zipper that enables the first fluid reservoir to be zippered to the first pocket, a second reservoir-pocket zipper that enables the second fluid reservoir to be zippered to the second pocket, and a first flexible connecting tube connecting said first fluid reservoir to a mouthpiece, and a second flexible connecting tube connecting said second fluid reservoir to said mouthpiece, said mouthpiece comprising a selector valve to allow a user to select between drinking from said first fluid reservoir and said second fluid reservoir.

2. The garment according to claim 1, wherein said first flexible connecting tube is attached to said first fluid reservoir along a lateral side of said first fluid reservoir and said second flexible connecting tube is attached to said second fluid reservoir along a lateral side of said second fluid reservoir.

3. The garment according to claim 1, wherein each of said fluid reservoirs comprises one or more seams running along a portion of a length of said reservoir, thereby making said fluid reservoirs appear ribbed when filled with fluid.

4. The garment according to claim 3, wherein said one or more seams of at least one of said fluid reservoirs runs vertically along a portion of a length of said reservoir.

5. The garment according to claim 1, wherein said jacket further comprises a first tube channel through which said first flexible connecting tube passes and a second tube channel through which said second flexible connecting tube passes.

6. The garment according to claim 5, wherein each of said first and second tube channels runs in part through the collar of said jacket.

7. The garment according to claim 1, wherein said mouthpiece selector valve allows a user to shut-off fluid flow from both of said first and second fluid reservoirs.

8. The garment according to claim 1, wherein said mouthpiece selector valve allows a user to drink from both of said first and second fluid reservoirs simultaneously.

9. The garment according to claim 1, wherein said mouthpiece selector valve allows a user to simultaneously shut-off fluid flow from one of said first and second fluid reservoirs while permitting flow from the other of said first and second fluid reservoirs.

10. The garment according to claim 1, wherein each of the sleeves of said jacket comprises a sleeve opening and a sleeve cuff opening to permit a wearer to alternately open and close the sleeve at the cuff.

11. The garment according to claim 10, wherein each of said sleeve openings comprises a zipper for alternately opening and closing said sleeve openings.

12. The garment according to claim 11, wherein each of said sleeve cuff openings further comprises a hook-and-loop fastener for securing each sleeve cuff about the wrist of a wearer.

13. The garment according to claim 10, wherein each of said sleeve cuff openings is from one inch to six inches in length.

14. The garment according to claim 10, wherein each of said sleeve cuff openings is from two inches to five inches in length.

15. The garment according to claim 10, wherein each of said sleeve cuff openings is from three inches to four inches in length.

16. The garment according to claim 1, wherein said jacket further comprises a removable face warmer attached to the collar of said jacket.

* * * * *